US005910057A

United States Patent [19]

Quimby et al.

[11] Patent Number: 5,910,057

[45] Date of Patent: Jun. 8, 1999

[54] GOLF BALL WITH DISTANCE AND LOCATING SYSTEM

[76] Inventors: Robert W. Quimby; Doreen S. Quimby, both of P.O. Box 1053, Ephrata, Wash. 98823, personal representative of said Dorren S. Quimby, deceased

[21] Appl. No.: 08/783,354

[22] Filed: Jan. 16, 1997

[51] Int. Cl.[6] ..... A63B 37/08; A63B 43/00

[52] U.S. Cl. ..... 473/353; 473/407

[58] Field of Search ..... 473/353, 407

[56] References Cited

U.S. PATENT DOCUMENTS

| | | | |
|---|---|---|---|
| 3,868,692 | 2/1975 | Woodard et al. | 473/407 |
| 4,656,476 | 4/1987 | Tavtigian | 473/407 X |
| 5,423,549 | 6/1995 | Englmeier | 473/353 |

*Primary Examiner*—George J. Marlo

[57] ABSTRACT

A new Golf Ball Distance and Locating System for determining the distance a golf ball was driven and for locating the golf ball within difficult to locate terrain. The inventive device includes a transmitter concentrically positioned within the golf ball, a receiver for determining distance and direction of the golf ball from a golfer. The transmitter is surrounded by an impermeable encasement which is positioned within a protective gel contained by a gel container for reducing shock impact from striking the golf ball thereby reducing the chance of damage to the transmitter. The gel container is positioned within a viscous liquid concentrically filling the golf ball thereby providing additional protection for the transmitter from the shock impact. The transmitter emits a high frequency signal which is detected by the receiver which thereafter determines the distance from the receiver and the direction of the golf ball in relation to a projected direction of the receiver.

8 Claims, 4 Drawing Sheets

FIG 1
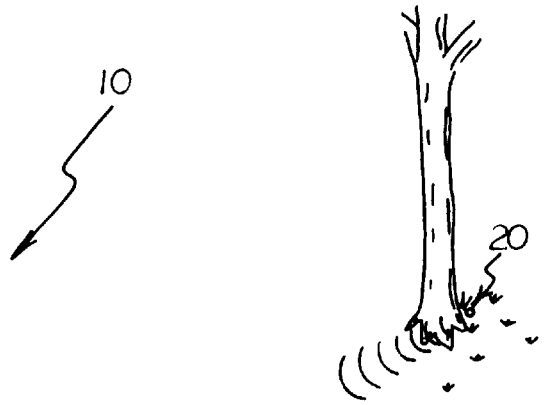
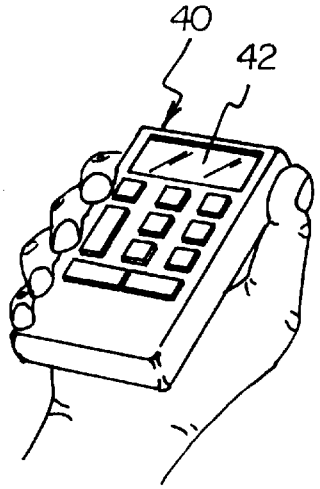
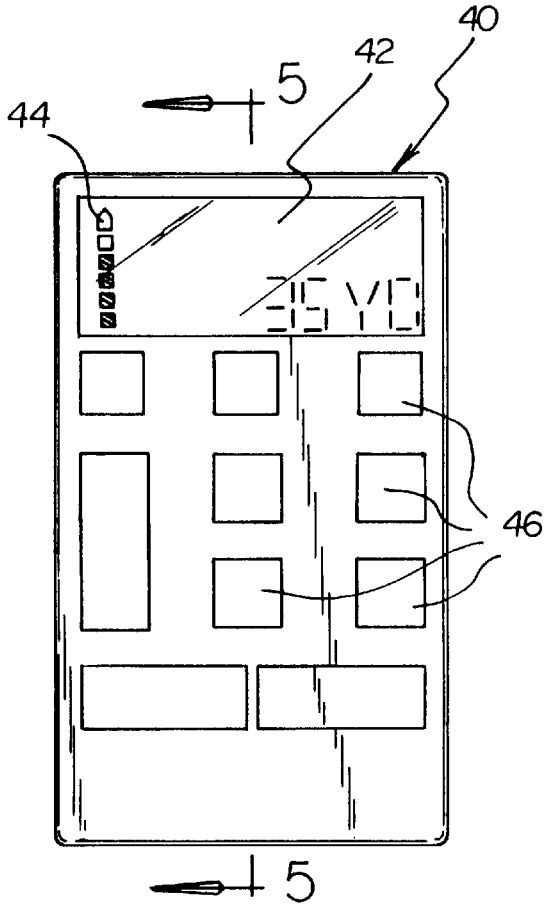
FIG 2

FIG 3
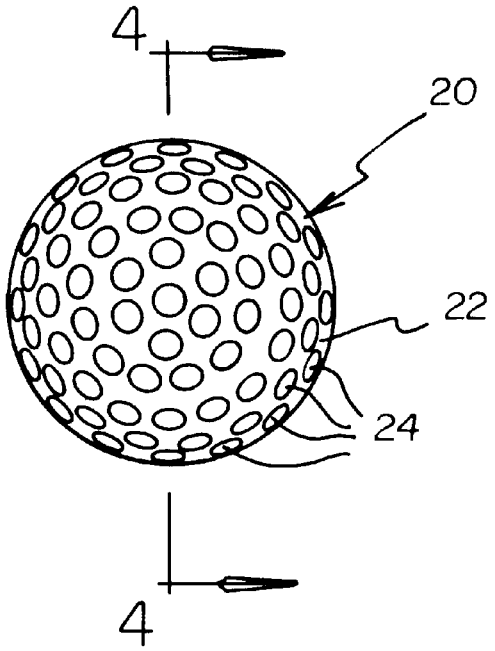
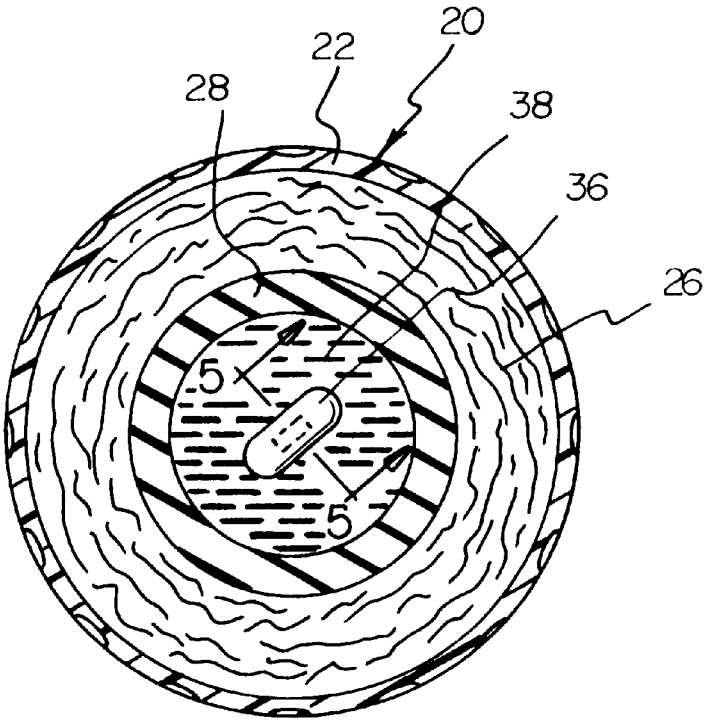
FIG 4

FIG 6
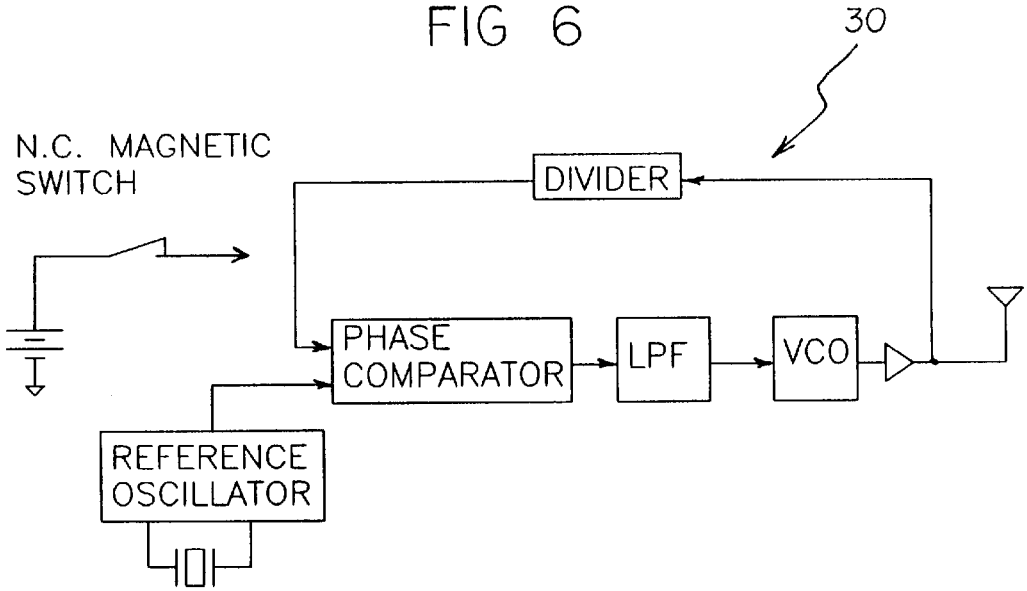
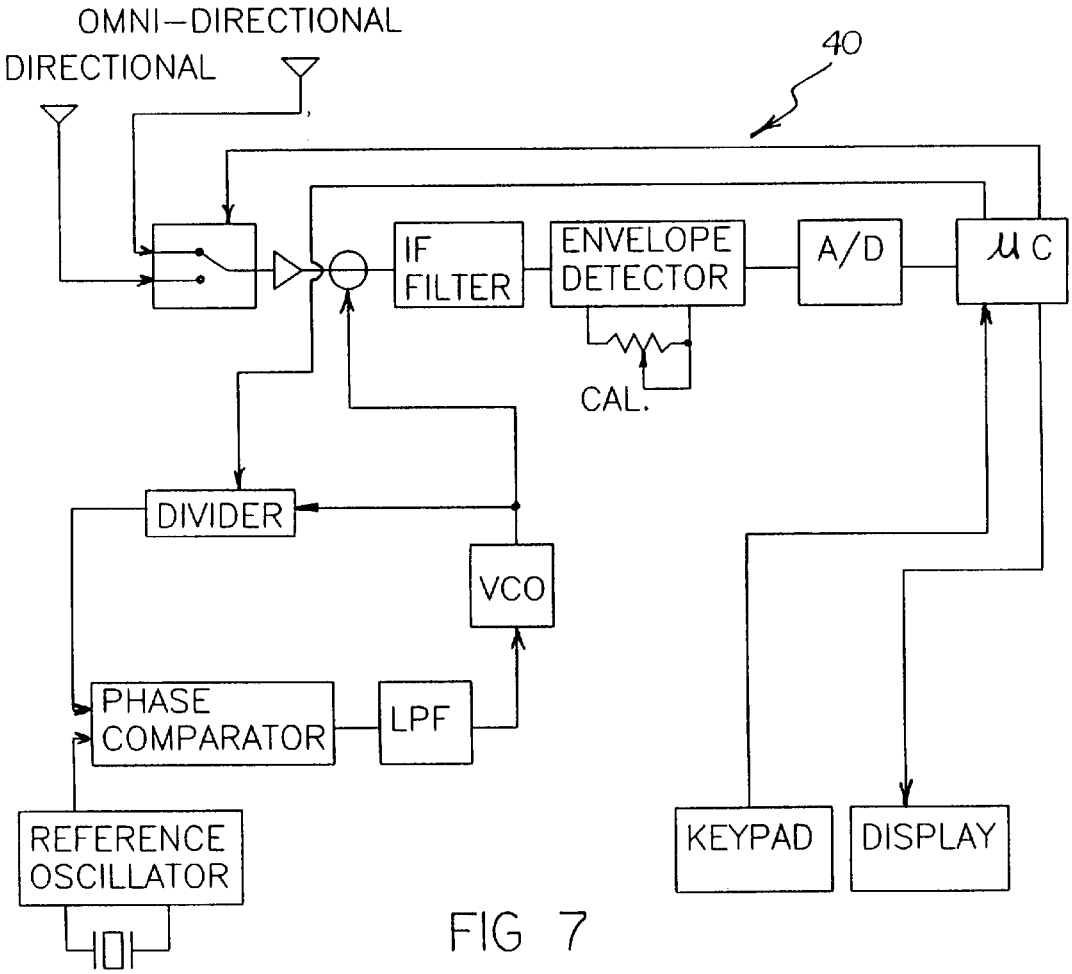
FIG 7

GOLF BALL WITH DISTANCE AND LOCATING SYSTEM

BACKGROUND OF THE INVENTION

1. Field of the Invention

The present invention relates to Golf Ball Locating Devices and more particularly pertains to a new Golf Ball Distance and Locating System for determining the distance a golf ball was driven and for locating the golf ball within difficult to locate terrain.

2. Description of the Prior Art

The use of Golf Ball Locating Devices is known in the prior art. More specifically, Golf Ball Locating Devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art Golf Ball Locating Devices include U.S. Pat. No. 5,447,314; U.S. Pat. No. 5,423,549; U.S. Pat. No. 5,298,904; U.S. Pat. No. 4,698,781; U.S. Pat. No. 4,528,566 and U.S. Design Pat. No. 355,943.

While these devices fulfill their respective, particular objectives and requirements, the aforementioned patents do not disclose a new Golf Ball Distance and Locating System. The inventive device includes a transmitter concentrically positioned within the golf ball, a receiver for determining distance and direction of the golf ball from a golfer.

In these respects, the Golf Ball Distance and Locating System according to the present invention substantially departs from the conventional concepts and designs of the prior art, and in so doing provides an apparatus primarily developed for the purpose of determining the distance a golf ball was driven and for locating the golf ball within difficult to locate terrain.

SUMMARY OF THE INVENTION

In view of the foregoing disadvantages inherent in the known types of Golf Ball Locating Devices now present in the prior art, the present invention provides a new Golf Ball Distance and Locating System construction wherein the same can be utilized for determining the distance a golf ball was driven and for locating the golf ball within difficult to locate terrain.

The general purpose of the present invention, which will be described subsequently in greater detail, is to provide a new Golf Ball Distance and Locating System apparatus and method which has many of the advantages of the Golf Ball Locating Devices mentioned heretofore and many novel features that result in a new Golf Ball Distance and Locating System which is not anticipated, rendered obvious, suggested, or even implied by any of the prior art Golf Ball Locating Devices, either alone or in any combination thereof.

To attain this, the present invention generally comprises a transmitter concentrically positioned within the golf ball, a receiver for determining distance and direction of the golf ball from a golfer.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new Golf Ball Distance and Locating System apparatus and method which has many of the advantages of the Golf Ball Locating Devices mentioned heretofore and many novel features that result in a new Golf Ball Distance and Locating System which is not anticipated, rendered obvious, suggested, or even implied by any of the prior art Golf Ball Locating Devices, either alone or in any combination thereof.

It is another object of the present invention to provide a new Golf Ball Distance and Locating System which may be easily and efficiently manufactured and marketed.

It is a further object of the present invention to provide a new Golf Ball Distance and Locating System which is of a durable and reliable construction.

An even further object of the present invention is to provide a new Golf Ball Distance and Locating System which is susceptible of a low cost of manufacture with regard to both materials and labor, and which accordingly is then susceptible of low prices of sale to the consuming public, thereby making such Golf Ball Distance and Locating System economically available to the buying public.

Still yet another object of the present invention is to provide a new Golf Ball Distance and Locating System which provides in the apparatuses and methods of the prior art some of the advantages thereof, while simultaneously overcoming some of the disadvantages normally associated therewith.

Still another object of the present invention is to provide a new Golf Ball Distance and Locating System for determining the distance a golf ball was driven and for locating the golf ball within difficult to locate terrain.

Yet another object of the present invention is to provide a new Golf Ball Distance and Locating System which includes a transmitter concentrically positioned within the golf ball, a receiver for determining distance and direction of the golf ball from a golfer.

Still yet another object of the present invention is to provide a new Golf Ball Distance and Locating System that increases the chance that a golfer will locate a golf ball after driving the golf ball.

Even still another object of the present invention is to provide a new Golf Ball Distance and Locating System that allows a golfer to consistently determine the distance a golf ball was driven with a selected golf club.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is an upper perspective view of the golf ball surrounded by a tree and grass emitting the high frequency signal which is detected by the receiver.

FIG. 2 is a top view of the receiver.

FIG. 3 is a top view of the golf ball.

FIG. 4 is a cross sectional view taken along line 4—4 of FIG. 3 disclosing the transmitter.

FIG. 6 is a box diagram of the transmitter which is comprised of conventional circuiter well known in the art.

FIG. 7 is a box diagram of the receiver which is comprised of conventional circuiter well known in the art.

DESCRIPTION OF THE PREFERRED EMBODIMENTS

Figure 5:
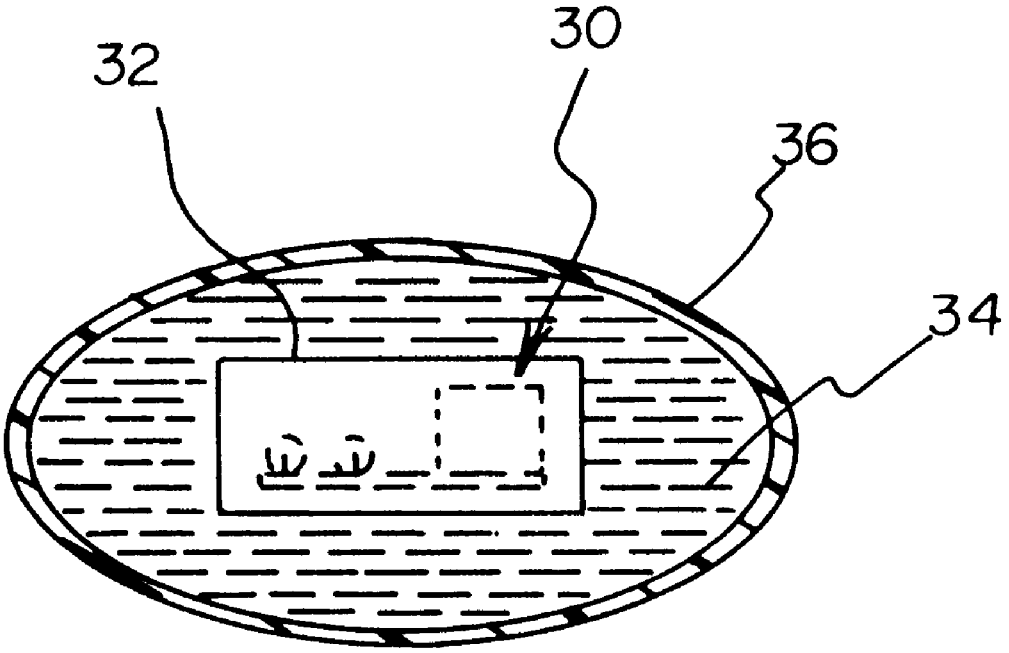
FIG. 5 is a cross sectional view taken along line 5—5 of FIG. 4.

With reference now to the drawings, and in particular to FIGS. 1 through 7 thereof, a new Golf Ball Distance and Locating System embodying the principles and concepts of the present invention and generally designated by the reference numeral 10 will be described.

More specifically, it will be noted that the Golf Ball Distance and Locating System 10 comprises a transmitter 30 concentrically positioned within the golf ball 20, a receiver 40 for determining distance and direction of the golf ball 20 from a golfer. The transmitter 30 constantly transmits a high frequency signal for allowing location of the golf ball 20 anytime. The receiver 40 detects the signal as shown in FIG. 1 of the drawings. Upon detection of the signal, the receiver 40 calculates and shows a distance of the golf ball 20 upon a display 42, thereby informing a golfer of the distance to the golf ball 20 from the receiver 40. The signal transmitted by the transmitter 30 is preferably at a frequency greater than 900 MHz for allowing consistent and accurate measurement of the distance without an extremely long antenna required.

As shown in FIGS. 4 and 5 of the drawings, the transmitter 30 is positioned within an impermeable encasement 32 for protecting the transmitter. The impermeable encasement 32 is positioned within a protective gel 34 contained by a gel container 36 positioned within the golf ball 20 for reducing the chance of damage to the transmitter 30 upon striking of the golf ball 20 by the golfer as best shown in FIG. 5 of the drawings.

As shown in FIG. 4 of the drawings, the golf ball 20 comprises a viscous liquid 38 contained concentrically within a rubber core 28. The gel container 36 is positioned within the viscous liquid 38 for protecting the transmitter 30. A rubber winding 26 surrounds the rubber core 28 and a covering 22 having a plurality of dimples 24 surrounds the rubber winding 26 as shown in FIG. 4 of the drawings.

As shown in FIGS. 1 and 2 of the drawings, the receiver 40 includes a display 42 for disclosing to the golfer the distance of the golf ball 20 from the receiver 40 thereby allowing the golfer to locate the golf ball 20 by adjusting his or her direction according to an increase or decrease in the distance. Alternatively, the receiver 40 includes a bar graph directional indicator 44 which discloses to the golfer a strength of the signal in relation to a projected direction of the receiver 40 as shown in FIG. 2 of the drawings. The bar graph directional indicator 44 allows the golfer to quickly locate the golf ball 20 without having to utilize a trial by error method of locating the golf ball 20 as stated above. The receiver 40 preferably has a keypad 46 for allowing entering of desired measurement units of the distance and various other information relevant for calibrating the receiver 40 over extended periods of time.

In use, the user activates the receiver 40 by pressing a power switch upon the keypad 46. The golf ball 20 is driven by the golfer an unknown distance. The transmitter 30 transmits the signal which is received by the receiver 40 which thereafter calculates the distance the golf ball 20 is from the receiver 40 in the units selected by the golfer. The receiver 40 electically controls the display 42 to show the calculated distance whereby the golfer is able to view. The bar graph directional indicator 44 shows the golfer what direction the golf ball 20 is from the receiver 40 by simply pointing the receiver 40 until the highest level is received upon the bar graph directional indicator 44.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A golf ball distance measuring and locating system comprising a transmitter positioned concentrically within a golf ball and having transmitting circuitry adapted to transmit a constant high frequency signal; and a receiver for detecting said high frequency signal, said receiver having a visual display and processing circuitry for calculating and displaying on said visual display the distance of said golf ball from said receiver to thereby inform a golfer of said distance;

wherein said transmitter is positioned within an impermeable encasement, wherein said impermeable encasement is positioned within a protective gel contained by a gel container positioned within said golf ball for reducing the chance of damage to said transmitter upon striking of said golf ball by said golfer.

2. The golf ball distance measuring and locating system of claim 1 wherein said golf ball comprises:

a viscous liquid contained concentrically within a rubber core, wherein said gel container is positioned within said viscous liquid;

a rubber winding surrounding said rubber core; and a covering having a plurality of dimples, wherein said covering surrounds said rubber winding.

3. The golf ball distance measuring and locating system of claim 2 wherein said receiver includes a bar graph directional indicator which discloses to said golfer a strength of said signal in relation to a projected direction of said receiver thereby allowing said golfer to quickly locate said golf ball without having to utilize a trial by error method of locating said golf ball.

4. The golf ball distance measuring and locating system of claim 3 wherein said receiver includes a keypad for allowing entering of desired measurement units of said distance.

5. The golf ball distance measuring and locating system of claim 4 wherein said signal is transmitted at a frequency greater than 900 MHz.

6. The golf ball distance measuring and locating system of claim 1 wherein said receiver includes a bar graph directional indicator which discloses to said golfer a strength of said signal in relation to a projected direction of said receiver thereby allowing said golfer to quickly locate said golf ball without having to utilize a trial by error method of locating said golf ball.

7. The golf ball distance measuring and locating system of claim 1 wherein said receiver includes a keypad for allowing entering of desired measurement units of said distance.

8. The golf ball distance measuring and locating system of claim 1 wherein said signal is transmitted at a frequency greater than 900 MHz.

* * * * *